US006489271B1

(12) United States Patent
Richardson

(10) Patent No.: US 6,489,271 B1
(45) **Date of Patent: *Dec. 3, 2002**

(54) COMBINATION OF A SULFUR COMPOUND AND SPECIFIC PHOSPHORUS COMPOUNDS AND THEIR USE IN LUBRICATING COMPOSITIONS, CONCENTRATES AND GREASES

(75) Inventor: Robert C. Richardson, Mentor, OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/697,115

(22) Filed: Aug. 20, 1996

Related U.S. Application Data

(63) Continuation of application No. 08/285,567, filed on Aug. 3, 1994, now abandoned.

(51) Int. Cl.[7] ..... C10M 141/10

(52) U.S. Cl. ..... 508/186; 508/291; 508/433; 508/435; 508/441; 508/569; 568/21

(58) Field of Search ..... 508/186, 291, 508/433, 435, 441, 569; 568/21

(56) References Cited

U.S. PATENT DOCUMENTS

| | | | | |
|---|---|---|---|---|
| 2,178,514 A | | 10/1939 | Prutton | 252/45 |
| 3,087,936 A | | 4/1963 | Le Suer | 260/326.3 |
| 3,197,405 A | | 7/1965 | Le Suer | 252/32.7 |
| 3,254,025 A | | 5/1966 | Le Suer | 252/32.7 |
| 3,282,955 A | | 11/1966 | Le Suer | 260/326.3 |
| 3,583,915 A | | 6/1971 | Myers | 252/46.6 |
| 3,899,475 A | | 8/1975 | Hotten | 260/97.5 |
| 4,119,549 A | | 10/1978 | Davis | 252/45 |
| 4,119,550 A | | 10/1978 | Davis et al. | 252/45 |
| 4,191,659 A | | 3/1980 | Davis | 252/45 |
| 4,344,854 A | | 8/1982 | Davis et al. | 252/45 |
| 4,431,552 A | | 2/1984 | Salentine | 252/32.7 |
| 4,564,709 A | | 1/1986 | Koyama et al. | 568/26 |
| 4,575,431 A | | 3/1986 | Salentine | 252/32.7 |
| 4,717,490 A | | 1/1988 | Salentine | 252/32.7 |
| 4,717,491 A | | 1/1988 | Cardis | 252/46.7 |
| 4,744,912 A | | 5/1988 | Cardis | 252/46.7 |
| 4,744,920 A | | 5/1988 | Fischer et al. | 252/33.4 |
| 4,752,416 A | | 6/1988 | Scharf et al. | 252/78.5 |
| 4,755,311 A | | 7/1988 | Burjes et al. | 252/49.9 |
| 4,900,460 A | | 2/1990 | Cardis | 252/46.6 |
| 4,938,882 A | | 7/1990 | Tipton | 252/3.8 |
| 4,962,227 A | * | 10/1990 | Wirth et al. | 252/32.5 |
| 4,965,002 A | * | 10/1990 | Brannen et al. | 252/32.5 |
| 4,997,968 A | | 3/1991 | Burjes et al. | 558/120 |
| 5,073,277 A | * | 12/1991 | Wirth et al. | 252/32.5 |
| 5,146,000 A | | 9/1992 | Ozbalik | 568/26 |
| 5,242,613 A | | 9/1993 | Ozbalik et al. | 252/46.7 |
| 5,250,737 A | | 10/1993 | Ozbalik | 568/21 |
| 5,354,484 A | | 10/1994 | Schwind et al. | 252/32.5 |
| 5,391,307 A | * | 2/1995 | Yamazaki et al. | 252/32.5 |
| 5,403,501 A | * | 4/1995 | Schwind | 252/45 |

FOREIGN PATENT DOCUMENTS

| | | |
|---|---|---|
| EP | 531585 | 9/1991 |
| EP | 578435 | 6/1993 |
| EP | 0580335 | 1/1994 |
| EP | 620268 | 3/1994 |
| WO | 8705927 | 10/1987 |
| WO | 8805810 | 8/1988 |
| WO | 9109922 | 7/1991 |
| WO | 9422990 | 10/1994 |

OTHER PUBLICATIONS

EP 95 30 5271, European Search Report mailed Feb. 16, 1996.

Reolube TPPT, CIBA–GEIGY, "Antiwear extreme pressure additive". (date unknown).

* cited by examiner

*Primary Examiner*—Jerry D Johnson
(74) *Attorney, Agent, or Firm*—Teresan W. Gilbert; Michael F. Esposito; David M. Shold

(57) ABSTRACT

This invention relates to a lubricating composition comprising a major amount of an oil of lubricating viscosity and (a) a extreme pressure improving amount of at least one sulfur compound, and an antiwear or an extreme pressure improving amount of the combination of (b) at least one ammonium salt of a phosphoric acid ester, (c) at least one phosphite, and (d) at least one thiophosphate or at least one reaction product of a phosphite and sulfur or a source of sulfur. The invention also relates to concentrates and greases containing the combination of the sulfur is compound and the specific phosphorus compounds.

22 Claims, No Drawings

COMBINATION OF A SULFUR COMPOUND AND SPECIFIC PHOSPHORUS COMPOUNDS AND THEIR USE IN LUBRICATING COMPOSITIONS, CONCENTRATES AND GREASES

This is a continuation of application(s) Ser. No. 08/285,567 filed on Aug. 3, 1994 now abandoned.

TECHNICAL FIELD OF THE INVENTION

This invention relates to the combination of a sulfur compound and specific phosphorus compounds. The invention also relates to lubricating compositions, concentrates and grease containing the combination.

BACKGROUND OF THE INVENTION

Lubricating compositions are used to prevent damage to machinery under operating conditions. Especially under boundary lubrication conditions, a lubricant must act to minimize harmful metal-to-metal contact. Often additives are useful at providing protection under boundary lubricating condition but sometimes these additive adversely affect other performance characteristics. For instance, a lubricant must still provide protection under high speed, shock loading condition, while not be corrosive to copper and other soft metals.

It is desirable to have a combination of additives which provide extreme pressure protection with out sacrificing other performance characteristics. A combination of additives is desired which will provide good extreme pressure properties to lubricants, which maintain the other parameters required of industry standards, such as API GL-5 and MIL-L2105D gear lubricant requirements.

SUMMARY OF THE INVENTION

This invention relates to a lubricating composition comprising a major amount of an oil of lubricating viscosity and (a) a extreme pressure improving amount of at least one sulfur compound, and an antiwear or an extreme pressure improving amount of the combination of (b) at least one ammonium salt of a phosphoric acid ester, (c) at least one phosphite, and (d) at least one thiophosphate or at least one reaction product of a phosphite and sulfur or a source of sulfur. The invention also relates to concentrates and greases containing the combination of the sulfur compound and the specific phosphorus compounds.

DETAILED DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g. pyridyl, furyl, thienyl, imidazolyl, etc.

In general, no more than about 2, preferably no more than one heteroatom substituent will be present for every ten carbon atoms in the hydrocarbyl group. Typically, there will be no such heteroatom substituents in the hydrocarbyl group. Therefore, the hydrocarbyl group is hydrocarbon.

As described above the lubricating compositions, concentrates, and grease contain a combination of (a) at least one sulfur compound and at least one mixture comprising (b) an ammonium salt of a phosphoric acid ester, (c) a phosphite, and (d) a thiophosphate or a reaction product of a phosphite and sulfur or a source of sulfur. In one embodiment, the sulfur compound (a) is present at concentrations in the range from about 0.1% to about 10% by weight, or preferably from about 0.2% up to about 8%, or more preferably from about 0.3% up to about 7%, more preferably from about 0.5% to about 5% by weight. Here, as well as elsewhere in the specification and claims, the range and ratio limits may be combined.

Sulfur Compounds

The sulfur compounds include mono- or polysulfide compositions, or mixtures thereof. The sulfur compounds are generally characterized as having sulfide linkages containing an average from 1 up to about 10, or from about 2 up to about 8, or from about 3 up to about 4 sulfur atoms. In one embodiment, the sulfur compound is a mixture of di-, tri- or tetrasulfide materials, preferably having a majority of trisulfide. Materials having at least 70% trisulfide are preferred, with materials containing greater than 80% trisulfide more preferred.

In one embodiment, the sulfur compound is prepared by sulfurizing unsaturated compounds. Materials which may be sulfurized include oils, unsaturated fatty acids, unsaturated fatty esters, olefins, terpenes, or Diels-Alder adducts. Oils which may be sulfurized are natural or synthetic oils, including mineral oils, lard oil, carboxylic acid esters derived from aliphatic alcohols and fatty acids or aliphatic carboxylic acids (e.g., myristyl oleate and oleyl oleate), and synthetic sperm whale oil substitutes and synthetic unsaturated esters or glycerides.

The unsaturated fatty acids generally contain from about 8 to about 30, or from about 12 to about 24 carbon atoms. Examples of unsaturated fatty acids include palmitoleic acid, oleic, linoleic, linolenic, erucic acid, lard oil acid, soybean oil acid, tall oil and rosin acid.

The unsaturated fatty esters include fatty oils, that is, naturally occurring or synthetic esters of glycerol and one or more of the above fatty acids. Examples of fatty esters include animal fats, such as Neat's-foot oil, lard oil, depot fat, beef tallow, and vegetable oils, including cottonseed oil, corn oil, safflower oil, sesame oil, soybean oil, and sunflower seed oil. The unsaturated fatty esters also may be prepared by esterifying alcohols and polyols with a fatty acid. The alcohols include the above described mono- and polyhydric alcohols, such as methanol, ethanol, propanol, butanol, ethylene glycol, neopentyl glycol, and glycerol.

The olefins, which may be sulfurized, contain at least one olefinic double bond, which is defined as a non-aromatic double bond. In its broadest sense, the olefin may be defined by the formula $R^{*1}R^{*2}C{=}CR^{*3}R^{*4}$, wherein each of R*l, R*, $R^{*3}$, and $R^{*4}$ is hydrogen, or an hydrocarbyl group. In general, the R* groups in the above formula which are not hydrogen may be represented by $-(CH_2)_n-A$, wherein n is a number from 0 to about 10 and A is represented by $-C(R^{*5})_3$, $-COOR^{*5}$, $-CON(R^{*5})_2$, $-COON(R^{*5})_4$, —COOM, —CN, —X, $-YR^{*5}$ or —Ar, wherein: each $R^{*5}$ is independently hydrogen, or a hydrocarbyl group, with the proviso that any two $R^{*5}$ groups may be connected to form a ring of up to about 12 carbon atoms; M is one equivalent of a metal cation (preferably Group I or II, e.g., sodium, potassium, barium, or calcium); X is halogen (e.g., chloro, bromo, or iodo); Y is oxygen or divalent sulfur; Ar is an aromatic group of up to about 12 carbon atoms.

The olefinic compound is usually one in which each R group which is not hydrogen is independently alkyl, alkenyl or aryl group, preferably an alkyl group. In one embodiment, $R^{*3}$ and $R^{*4}$ are hydrogen and $R^{*1}$ and $R^{*2}$ are alkyl or aryl, especially alkyl, having from 1 up to about 30, or from 1 up to about 16, or from 1 up to about 8 carbon atoms. Olefins having from 2 up to about 30, or from about 3 up to about 16 (most often less than about 9) carbon atoms are particularly useful. Olefins having from 2 up to about 8, or from 2 up to about 4 carbon atoms are particularly useful. Isobutene, propylene and their dimers, trimers and tetramers, and mixtures thereof are especially preferred olefins. Of these compounds, isobutylene and diisobutylene are particularly desirable. In one embodiment, the organic polysulfides may be a mixture of di-, tri-, or tetrasulfide materials, preferably having a majority of trisulfide. Materials having at least 70% trisulfide are preferred, with materials containing greater than 80% trisulfide more preferred.

In another embodiment, the organic polysulfide comprise sulfurized olefins prepared by the sulfochlorination of olefins containing four or more carbon atoms and further treatment with inorganic sulfides according to U.S. Pat. No. 2,708,199.

In one embodiment, the sulfurized olefins may be produced by (1) reacting sulfur monochloride with a stoichiometric excess of a lower olefin, e.g. containing two to about seven carbon atoms, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to about 5 carbon atoms and examples include ethylene, propylene, butylene, isobutylene, amylene, etc.

The organic polysulfide may also be the reaction product of a hydrocarbyl mercaptan, sulfur and an olefin. The mercaptans used to make the polysulfide may be hydrocarbyl mercaptans, such as those represented by the formula R—S—H, wherein R is a hydrocarbyl group as defined above. In one embodiment, R is an —alkyl, an alkenyl, cycloalkyl, or cycloalkenyl group. R may also be a haloalkyl, hydoxyalkyl, or hydroxyalkyl substituted (e.g. hydroxymethyl, hydroxyethyl, etc.) aliphatic groups. R generally contains from about 2 to about 30 carbon atoms, preferably from about 2 to about 24, more preferably from about 3 to about 18 carbon atoms. Examples include butyl mercaptan, amyl mercaptan, hexyl mercaptan, octyl mercaptan, 6-bydroxymethyl-octanethiol, nonyl mercaptan, decyl mercaptan, 10-amino-dodecanethiol, dodecyl mercaptan, 10-hydroxymethyl-tetradecanethiol, and tetradecyl mercaptan.

The sulfurized olefin may also be prepared by reacting, under superatmospheric pressure, the olefin with a mixture of sulfur and hydrogen sulfide in the presence, or absence, of a catalyst, such as an alkyl amine, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same.

The organic polysulfide generally has hydrocarbyl groups each independently having from about two to about 30, preferably from about two to about 20, and more preferably from about two to about 12. The hydrocarbyl groups may be aromatic or aliphatic, preferably aliphatic. In one embodiment, the hydrocarbyl groups are alkyl groups.

In one embodiment, the sulfur compound contains a mixture comprising at least about 90% dihydrocarbyl trisulfide, from about 0.5% up to about 8% dihydrocarbyl disulfide, and less than about 5% dihydrocarbyl higher polysulfides. Higher polysulfides are defined as containing four or more sulfide linkages. In one embodiment, the amount of trisulfide is at least about 92%, or preferably at least about 93%. In another embodiment, the amount of dihydrocarbyl higher polysulfides is less than 4%, or preferably less than about 3%. In one embodiment, the dihydrocarbyl disulfide is present in an amount from about 0.5% up to about 5%, or preferably from about 0.6% up to about 3%.

The sulfide analysis is performed on a Varian 6000 Gas Chromatograph and FID detector SP-4100 computing integrator. The Column is a 25 m. Megabore SGE BP-1. The temperature profile is 75° C., hold 2 min., to 250° C. at 6° C./min. The helium flow is 6.0 ml/min plus make-up. The injection temperature is 200° C. and the detector temperature is 260° C. The injection size is 0.6, ul. References are the monosulfide, disulfide and trisulfide analogues to the sulfur composition for analysis.

The references may be obtainied by fractionating the product to form sulfide fractions (S1, S2 and S3) to be used for analysis. The procedure for analysis is as follows. (1) An area % determination is run on each of the reference samples to determine its purity. (2) An area % determination is run on the sample to be tested to get a general idea of its composition. (3) A calibration blend is accurately weighed based on the area % results of the sample to be tested: then the internal standard toluene, is added to the blend in an amount equal to approximately one-half of the weight of the largest component. (This should give an area approximately the same as that of the largest component.) (4) The weights of each component (i.e., S-1, S-2 and S-3) are corrected by the % purity from step 1. (5) The calibration blend is run in triplicate using the corrected weights and then calculated, using the following formula, to reflect the multiple peaks in S-1 and S-2:

$$RF = \frac{\text{(concentration of components*)}}{\text{(total area of peaks)}} \frac{\text{(area of internal standard)}}{\text{(concentration of internal standard)}}$$

*Adjusted for purity of the standard i.e.: component weight times percent purity equals concentration of component (6) These response factors, plus the response factor for the single S-3 peak are used for determining weight percent results for the samples to be tested. (7) Results for S-1 and S-2 are adjusted to include all the peaks attributed to them. (8) Higher polysulfides are determined by difference using the following formula:

S-4=100%−(S-1+S-2+S-3+light ends)

Light ends are defined as any peaks eluded prior to the internal standard.

In one embodiment, the organic polysulfide is prepared as described above using hydrogen sulfide, sulfur, and at least olefin to form an intermediate. The intermediate is fractionally distilled to form the organic polysulfide. In one aspect, the fractional distillation occurs under subatmospheric pressure. Typically the distillation pressure is from about 1 to about 250, preferably from about 1 to about 100, or preferably from about 1 to about 25 mm Hg. A fractionation column, such a Snyder fractionation column may be used. In one embodiment, the fractionation is carried out at a reflux ratio of from about 2:1 up to about 8:1, preferably from about 3:1 up to about 7:1, or preferably from about 4:1 up to about 6:1. S-21.

The following examples relate to sulfurized olefins. Unless the context clearly indicates otherwise, here, as well as throughout the specification and claims, the amounts are by weight, the temperature is in degrees Celsius and the pressure is atmospheric.

EXAMPLE S-1

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid. The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

EXAMPLE S-2

Sulfur monochloride (2025 grams, 15.0 moles) is heated to 45° C. Through a sub-surface gas sparge, 1468 grams (26.2 moles) of isobutylene gas are fed into the reactor over a 5-hour period. The temperature is maintained between 45–50° C. At the end of the sparging, the reaction mixture increases in weight by 1352 grams. In a separate reaction vessel are added 2150 grams (16.5 moles) of 60% flake sodium sulfide, 240 grams (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C. The reaction mixture is heated to reflux for 6 hours, and afterward the mixture is permitted to form into separate layers. The lower aqueous layer is discarded. The upper organic layer is mixed with two liters of 10% aqueous sodium hydroxide, and the mixture is heated to reflux for 6 hours. The organic layer is again removed and washed with one liter of water. The washed product is dried by heating at 90° C. and 30 mm. Hg. pressure for 30 minutes. The residue is filtered through diatomaceous earth filter aid to give 2070 grams of a clear yellow-orange liquid.

EXAMPLE S-3

Charge 1000 lbs. of the product of Example S-1 to the reactor, under medium agitation, and heat to approximately 88° C.–94° C. Bring to equilibrium and maintain equilibrium for 30 minutes prior to collection of distillate. Set the reflux ratio at 4:1. Raise the temperature to 105° C. to ensure a steady distillation rate. Collection of the distillate will require approximately 20–24 hours and the yield will approximate 230–260 lbs. Raise the temperature to 105° C.–107° C. Bring the system to equilibrium and maintain for 30 minutes prior to collection of distillate. Set the reflux ratio at 4:1. Raise the temperature to 121° C.–124° C., in order to ensure a steady distillation rate. Collect distillate over 75–100 hours. The distillation yields approximately 300–400 lbs. of the desired product. The desired product contains 2.7% S2, 93.15% S3, 4.04% higher polysulfides.

EXAMPLE S-4

In a vessel with a fractionation column, bring 10,000 grams of the product of Example S-1 to a boil, approximately 200° F., under medium agitation. Bring the column to equilibrium by regulating the vapor temperature. Maintain the equilibrium for 30 minutes prior to collection of distillate. Set the reflux ratio at 5:1. Under these conditions, collect the distillate until the accumulation of distillate is less than 5 ml in 15 minutes. Collect 100 ml of the distillate containing 88 grams of distillate at a vapor temperature of 56° C. Raise the temperature of the vessel 15° F. Remove an additional aliquot of 50 grams in 65 ml of distillate, at a vapor temperature of 580° C. Collect 2000 ml of distillate and remove 1838 grams of distillate, continuing collection as long as the distillate rate stays greater than 5 ml/15 minutes. If boiling drops off, raise the temperature of the vessel 5.5° C. Continue collecting distillate until the distillation rate is less than 5 ml/15 minutes is achieved. The distillate contains approximately 473 grams of desired product. For the final collection of distillate, raise the temperature of the vessel 9° C. to 116° C., not exceeding 121° C. Remove 220 ml of the distillate, containing 214 grams of distillate at a vapor temperature of 69° C. Continue collection of the remainder of the distillate, containing approximately 4114 grams of the desired product, until the distillation rate is less than 5 ml/15 minutes. A yield after fractionation should approximate 6777 grams of the desired product. The desired product contains approximately 2% S2, 96.6% S3, and 1.3% higher polysulfides.

As described above the sulfur compound is used in combination with (b) at least one amine salt of a phosphoric acid ester, (c) at least one phosphite, and (d) at least one thiophosphate or at least one reaction product of a phosphite and sulfur or a source of sulfur. These components are present in an amount sufficient to improve the antiwear or extreme pressure properties of the lubricating compositions and greases. In one embodiment, the ammonium salt of a phosphoric acid esters (b) is present in an amount from about 0.1% up to about 5%, or from about 0.3% up to about 3%, or from about 0.5% up to about 2% by weight of the composition. In another embodiment, phosphite (c) is present in an amount from about 0.1% up to about 5%, or from about 0.2% up to about 3%, or from about 0.3% up to about 1% by weight of the composition. In another embodiment, the thiophosphate or the reaction product of a phosphite and sulfur or a source of sulfur (d) is present in an amount from about 0.1% up to about 5%, or from about 0.2% up to about 2%, or from about 0.2% up to about 1% by weight of the composition.

Ammonium Salt of Phosphoric Acid Esters

The amine salt of a phosphoric acid ester is prepared by reacting a phosporic acid ester with ammonia or a basic nitrogen compound, such as an amine or a nitrogen containing dispersant. The salts may be formed separately, and then the salt of the phosphorus acid ester may be added to the lubricating composition. Alternatively, the salts may also be formed in situ when the acidic phosphorus acid ester is blended with other components to form a fully formulated lubricating composition.

The ammonium salts of the phosphorus acid esters may be formed from ammonia, or an amine, or mixtures thereof. These amines may be monoamines or polyamines. Useful amines include those disclosed in U.S. Pat. No. 4,234,435 at Col. 21, line 4 to Col. 27, line 50, this section of this reference being incorporated herein by reference.

The monoamines generally contain from 1 to about 24 carbon atoms, with from 1 to about 12 carbon atoms being preferred, with from 1 to about 6 being more preferred. Examples of monoamines include methylamine, ethylamine, propylamine, butylamine, 2-ethylhexylamine, octylamine, and dodecylamine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

In one embodiment, the amine is a fatty (C830) amine which include n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Illinois), such Armeen C, Armeen O, Armeen OL, Armeen T, Armeen Hr, Armeen S and Armeen SD, wherein the letter designation relates to the fatty group, such as coco, oleyl, tallow, or stearyl groups.

Other useful amines include primary ether amines, such as those represented by the formula, $R''(OR')_xNH_2$, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAMS described above and used hereinafter are approximate and include the oxygen ether linkage.

In one embodiment, the amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines represented by the formula $R_5—C(R_6)_2—NH_2$, wherein $R_5$ is a hydrocarbyl group containing from 1 to about 27 carbon atoms and $R_6$ is a hydrocarbyl group containing from 1 to about 12 carbon atoms. Such amines are illustrated by t-butylamine, t-hexylamine, 1-methyl-1-amino-cyclohexane, t-octylamine, t-decylamine, t-dodecylamine, t-tetradecylamine, t-hexadecylamine, t-octadecylamine, t-tetracosanylamine, and t-octacosanylamine.

Mixtures of tertiary aliphatic amines may also be used in preparing the dithiocarbamic acid or salt. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are described in U.S. Pat. No. 2,945,749, which is hereby incorporated by reference for its teaching in this regard.

In one embodiment, the amine may be a hydroxyamine. Typically, the hydroxyamines are primary, secondary, or tertiary alkanol amines or mixtures thereof Such amines can be represented by the formulae: $H_2—N—R'—OH$, $H(R'_1)N—R'—OH$, and $(R'_1)_2—N—R'—OH$, wherein each R', is independently a hydrocarbyl group having from one to about eight carbon atoms or hydroxyhydrocarbyl group having from one to about eight carbon atoms, or from one to about four, and R' is a divalent hydrocarbyl group of about two to about 18 carbon atoms, or from two to about four. The group —R'—OH in such formulae represents the hydroxyhydrocarbyl group. R' can be an acyclic, alicyclic or aromatic group. Typically, R' is an acyclic straight or branched alkylene group, such as an ethylene, 1,2-propylene, 1,2-butylene, and 1,2-octadecylene groups. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group. Examples of these alkanolamines include mono-, di-, and triethanolamine, diethylethanolamine, ethylethanolamine, butyldietha-nolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of one or more of the above epoxides with aforedescribed amines and may be represented by the formulae: $H_2N—(R'O)_x—H$, $H(R'_1)—N—(R'O)_x—H$, and $(R'_1)_2—N—(R'O)_x—H$, wherein x is a number from about 2 to about 15 and $R'_1$ and R' are as described above. $R'_1$ may also be a hydroxypoly(hydrocarbyloxy) group.

In another embodiment, the amine is a hydroxyamine which may be represented by the formula

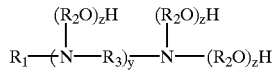

wherein $R_1$ is a hydrocarbyl group containing from about 6 to about 30 carbon atoms; $R_2$ is an alkylene group having from about two to about twelve carbon atoms, preferably an ethylene or propylene group; $R_3$ is an alkylene group containing from 1 up to about 8, or from 1 up to about 5 carbon atoms; y is zero or one; and each z is independently a number from zero to about 10, with the proviso that at least one z is zero.

Useful hydroxyhydrocarbyl amines where y in above formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethylhexylamine.

In one embodiment, the amine may be a hydroxyhydrocarbyl amine, where referring to the above formula, y equals zero. These hydroxyhydrocarbyl amines are available from the Akzo Chemical Division of Akzona, Inc., Chicago, Ill., under the general trade designations "Ethomeen" and "Propomeen". Specific examples of such products include: Ethomeen C/15, which is an ethylene oxide condensate of a coconut fatty acid containing about 5 moles of ethylene oxide; Ethomeen C/20 and C/25, which are ethylene oxide condensation products from coconut fatty acid containing about 10 and 15 moles of ethylene oxide, respectively; Ethomeen O/12, which is an ethylene oxide condensation product of oleyl amine containing about 2 moles of ethylene oxide per mole of amine; Ethomeen S/15 and S/20, which are ethylene oxide condensation products with stearyl amine containing about 5 and 10 moles of ethylene oxide per mole of amine, respectively; Ethomeen T/12, T/15 and T/25, which are ethylene oxide condensation products of tallow amine containing about 2, 5 and 15 moles of ethylene oxide per mole of amine, respectively; and Propomeen O/12, which is the condensation product of one mole of oleyl amine with 2 moles propylene oxide.

The amine may also be a polyamine. The polyamines include alkoxylated diamines, fatty polyamine diamines, alkylenepolyamines, hydroxy containing polyamines, condensed polyamines, arylpolyamines, and heterocyclic polyamines. Commercially available examples of alkoxylated diamines include those amines where y in the above formula is one. Examples of these amines include Ethoduomeen T/13 and T/20, which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O(N-oleyl-1,3-diaminopropane). "Duomeens" are commercially available from Armak Chemical Co., Chicago, Ill.

In another embodiment, the amine is an alkylenepolyamine. Alkylenepolyamines are represented by the formula $HR_4N—(Alkylene\text{-}N)_n—(R_4)_2$, wherein each $R_4$ is independently hydrogen; or an aliphatic or hydroxy-substituted aliphatic group of up to about 30 carbon atoms; n is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, $R_4$ is defined the same as $R'_1$ above. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyarine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylenepolyamine bottoms obtained from the Dow Chemical Company of Freeport, Texas designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetraamine, 21.74% tetraethylenepentaamine and 76.61% pentaethylenehexamine and higher analogs. These alkylenepolyamine bottoms include cyclic condensation products such as piperazine and higher analogs of diethylenetriamine, triethylenetetramine and the like. These alkylenepolyamine bottoms may be reacted solely with the acylating agent or they may be used with other amines, polyamines, or mixtures thereof.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl)amino methane, 2-amino-2-methyl-1,3-propanediol, N,N,N',N'-tetrakis (2-hydroxypropyl)

ethylenediamine, and N,N,N',N'-tetrakis (2-hydroxyethyl) ethylenediamine, preferably tris(hydroxymethyl) aminomethane (THAM).

Polyamines which may react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms". The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO 86/05501 and U.S. Pat. No. 5,230,714 (Steckel) which are incorporated by reference for its disclosure to the condensates and methods of making. A particularly useful amine condensate is prepared from HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and tris (hydroxymethyl)-aminomethane (THAM).

In another embodiment, the polyamines are polyoxyalkylene polyamines, e.g. polyoxyalkylene diamines and polyoxyalkylene triamines, having average molecular weights ranging from about 200 to about 4000, or from about 400 to about 2000. The preferred polyoxyalkylene polyamines include the polyoxyethylene and polyoxypropylene diamines and the polyoxypropylene triamines. The polyoxyalkylene polyamines are commercially available and may be obtained, for example, from the Jefferson Chemical Company, Inc. under the trade name "Jeffamines D-230, D-400, D-1000, D-2000, T-403, etc.". U.S. Patents 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N-(diethanol)ethylene diamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary or tertiary alkanol amines with ethylene, propylene or higher epoxides in a 1.1 to 1.2 molar ratio. Reactant ratios and temperatures for carrying out such reactions are known to those skilled in the art. Specific examples of hydroxy-containing polyamines include N-(2-hydroxyethyl) ethylenediamine, N,N'-bis(2-hydroxyethyl)-ethylenediamine, 1-(2-hydroxyethyl)-piperazine, mono (hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the above described polyamines are also useful.

In another embodiment, the polyamine is a heterocyclic polyamine. The heterocyclic polyamines include aziridines, azetidines, azolidines, tetra- and dihydro-pyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and per-hydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

Hydrazine and hydrocarbyl substituted-hydrazine may also be used to form the ammonium salts. At least one of the nitrogen atoms in the hydrazine must contain a hydrogen directly bonded thereto. Preferably there are at least two hydrogens bonded directly to hydrazine nitrogen and, more preferably, both hydrogens are on the same nitrogen. Specific examples of substituted hydrazines are methylhydrazine, N,N-dimethyl-hydrazine, N,N'-dimethyl-hydrazine, phenylhydrazine, N-phenyl-N'-ethyl-hydrazine, N-(para-tolyl)-N'-(n-butyl)-hydrazine, N-(para-nitrophenyl)-hydrazine, N-(para-nitrophenyl)-N-methyl-hydrazine, N,N'-di(para-chlorophenol)-hydrazine, N-phenyl-N'-cyclohexyl-hydrazine, and the like.

The phosphoric acid ester may be prepared by reacting one or more phosphorus acids or anhydrides with an alcohol containing from one to about 30, or from two to about 24, or from about 3 to about 12 carbon atoms. The phosphorus acid or anhydride is generally an inorganic phosphorus reagent, such as phosphorus pentoxide, phosphorus trioxide, phosphorus tetroxide, phosphorous acid, phosphoric acid, phosphorus halide, or one or more $C_{1-7}$ phosphorus esters. The alcohols generally contain from one to about 30, or from two to about 24, or from about 3 to about 12, or up to about 8 carbon atoms. Alcohols used to prepare the phosphoric acid esters include butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography); and Alfol 22+ alcohols ($C_{18}$–$C_{28}$ primary alcohols containing primarily $C_{22}$ alcohols). Alfol alcohols are available from Continental Oil Company. Another example of a commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha-olefin fraction of $C_{11}$–$C_{14}$, and the latter is derived from a $C_{15}$–$C_{18}$ alpha-olefin fraction.

The following examples relate to amine salts of phosphoric acid esters. Unless the context indicates otherwise, temperatures are in degrees Celsius, pressure is atmospheric, and the parts and percentages are by weight.

EXAMPLE P-1

To a fatty alcohol (6 moles) having an average of 13 carbon atoms and obtained by the hydrogenation of coconut oil there is added at 50–80° C. within a period of 2.5 hours, 2 moles of phosphorus pentoxide. The mixture is heated at 80° C. for 3 hours and filtered. The filtrate is the desired partially esterified phosphoric acid, having a phosphorus content of 8.5% and an acid number of 216 (phenolphthalein indicator). To 518 grams (2 acid equivalents) of this acidic ester there is added at 35–60° C. a stoichiometrically equivalent amount (i.e., 2 equivalents) of Primene 81-R, a commercial tertiary- alkyl primary amine mixture having from 11 to 14 carbon atoms in the alkyl group and an average equivalent weight of 191 (based on nitrogen). The resulting mixture is agitated for 30 minutes. The product is a salt of the amine and the acidic ester having a phosphorus content of 4.7% and a nitrogen content of 3.1%.

EXAMPLE P-2

A salt is prepared by the procedure of Example P-1 except that the partially esterified phosphoric acid used is derived from a mixture of 3 moles of primary-pentyl alcohol and 1 mole of phosphorus pentoxide.

EXAMPLE P-3

Alfol 8–10 (2628 parts, 18 moles) is heated to a temperature of about 45° C. whereupon 852 parts (6 moles) of phosphorus pentoxide are added over a period of 45 minutes while maintaining the reaction temperature between about 45–65° C. The mixture is stirred an additional 0.5 hour at this temperature, and is there- after heated at 70° C. for about 2–3 hours. Primene 81-R (2362 parts, 12.6 moles) is added dropwise to the reaction mixture while maintaining the temperature between about 30–50° C. When all of the amine has been added, the reaction mixture is filtered through a filter aid, and the filtrate is the desired amine salt containing 7.4% phosphorus (theory, 7.1%).

EXAMPLE P-4

To 1000 parts (3.21 moles) of an alkyl phosphoric acid ester mixture prepared as in Example P-3, there is added 454 parts (3.7 moles) of di-n-butyl amine and maintaining an atmosphere of nitrogen. Over the period of addition, the reaction mixture is heated to and maintained at a temperature of 120° C. After all of the butyl amine has been added, the mixture is maintained at 120° C. for 8 hours. The desired amine salt is obtained and contains 7.1% phosphorus (theory, 6.8%) and 3.4% nitrogen (theory, 3.6%).

EXAMPLE P-5

To 721.4 parts (2.31 moles) of an alkyl phosphoric acid mixture as prepared in Example P-3, there is added 613.7 parts (2.54 moles) of di-(2-ethyl-hexylamine) in an atmosphere of nitrogen. As the amine is added, the temperature of the reaction mixture rises from 20° C. to 120° C. The reaction mixture is maintained at this temperature for 5 hours to yield the desired product containing 3.4% phosphorus (theory, 3.0%) and 2.7% nitrogen (theory, 2.7%).

EXAMPLE P-6

A reaction vessel is charged with 793.4 parts (9 moles) of n-amyl alcohol, and 426 parts (3 moles) of phosphorus pentoxide is added over a period of 1.5 hours incrementally while maintaining the reaction temperature between about 55–70° C. After all of the phosphorus pentoxide has been added, the mixture is stirred for 0.5 hour. The reaction mixture then is maintained at 70° C. for 3 hours. Primene 81-R (1597.9 parts, 5.93 moles) is added dropwise to the reaction mixture while maintaining the temperature between 50–70° C. After all of the Primene 81-R has been added, the reaction mixture is filtered through a filter aid to yield the desired amine salt containing 6.1% phosphorus (theory, 5.8%).

EXAMPLE P-7

To 1500 parts (4.81 moles) of the alkyl phosphoric acid mixture prepared as in Example P-3, there is added 1423.5 parts (5.29 moles) of Armeen 0 (oleyl amine) over a period of 2 hours in a nitrogen atmosphere. After all of the amine is added, the mixture is heated to 80° C. and maintained at this temperature for 3 hours to form the desired product containing 5.4% phosphorus (theory, 5.1%) and 2.5% nitrogen (theory, 2.5%).

EXAMPLE P-8

A mixture of 539.8 parts (3.7 moles) of Alfol 8–10 and 326 parts (3.7 moles) of n-amyl alcohol is prepared and heated to 30° C. whereupon 350 parts (2.46 moles) of phosphorus pentoxide are added incrementally utilizing a cold water bath to maintain the temperature of the reaction mixture at 50–60° C. After all of the phosphorus pentoxide is added, the mixture is stirred an additional 0.5 hour and thereafter maintained at a temperature of 70° C. for 3 hours. The phosphoric acid mixture is cooled to about 40° C. whereupon 925.6 parts (4.95 moles) of Primene 81-R are added dropwise over a period of 2 hours. The reaction mixture is exothermic to 70° C., and after all of the amine is added, the mixture is filtered through a filter aid and the filtrate is the desired amine salt containing 5.5% phosphorus and 3.2% nitrogen (theory, 3.24%).

Phosphites

As described above the lubricating compositions, concentrates, and greases contain at least one phosphite. The phosphite may be a di- or trihydrocarbyl phosphite. Preferably each hydrocarbyl group contains from 1 to about 24 carbon atoms, more preferably from 1 to about 18 carbon atoms, and more preferably from about 2 to about 8 carbon atoms. Each hydrocarbyl group may be independently alkyl, alkenyl, or aryl. When the hydrocarbyl group is an aryl group, then it contains at least about 6 carbon atoms; preferably about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptyl-phenol, etc. Preferably each hydrocarbyl group is independently propyl, butyl, pentyl, hexyl, heptyl, oleyl or phenyl, more preferably butyl, oleyl or phenyl and more preferably butyl or oleyl. One method of preparing phosphites includes reacting a lower ($C_{1-8}$) Phosphites and their preparation are known and many phosphites are available commercially. Particularly useful phosphites are dibutyl hydrogen phosphite, dioleyl hydrogen phosphite, di($C_{1418}$) hydrogen phosphite, and triphenyl phosphite.

Thiophosphate or Reaction Products of Phosphite and Sulfur or a Source of Sulfur As described above the lubricating compositions, concentrates, and greases contains at least one thiophosphate or at least one reaction product of a phosphite and sulfur or a source of sulfur or at least one thiophosphate, preferably a monothiophosphate. The thiophosphates may be dihydrocarbyl thiophosphates, trihydrocarbyl thiophosphates, or mixture thereof. The hydrocarbyl groups are defined below. The phosphites may be any of the above described phosphites. Preferably the phosphite is a trihydrocarbyl phosphite, more preferably a triaryl phosphite. The hydrocarbyl group typically contain from about 6 to about 24, preferably from about 6 to about 18, more preferably from about 6 to about 12 carbon atoms. Examples of useful hydrocarbyl groups include benzyl, methylbenzyl, dimethylbenzyl, methoxyphenyl, etc. A particularly useful phosphite is triphenylphosphite.

As discussed above the phosphite is reacted with sulfur or a source of sulfur. The sulfur source may be any of a variety of materials which are capable of supplying sulfur to the reaction. Examples of useful sulfur sources include sulfur halides, combinations of sulfur or sulfur oxides with hydrogen sulfide, and various sulfur containing organic compounds. The sulfur halides include sulfur monochloride, sulfur dichloride, etc. The sulfur sources may also be sulfur containing organic compounds, such as aromatic and alkyl sulfides, dialkenyl sulfides, sulfurized olefins, sulfurized oils, sulfurized fatty acid esters, sulfurized aliphatic esters of olefinic mono- or dicarboxylic acids, diester sulfides, sulfurized Diels-Alder adducts and sulfurized terpenes. U.S. Pat. No. 4,755,311 discloses various sulfur sources capable of supplying sulfur to reaction. This patent is incorporated by reference for its disclosure of sulfur sources.

In one embodiment, the thiophosphate is at least one compound of the structure:

$$(RX)_3P{=}X$$

where each X is independently sulfur or oxygen, provided that at least one X is sulfur, and wherein each R is independently a hydrocarbyl group. The hydrocarbyl groups are described above.

The following example relates to preparation of thiophosphates.

EXAMPLE P-9

A reaction vessel is charged with 1204 parts (3.69 equivalents) of triphenylphosphite. The phosphite is heated to 160° C. under nitrogen where 112 parts (3.51 equivalents) of sulfur is added over three hours. The reaction temperature is maintained at 160° C. for four hours. (In an alternative process, the mixture is thereafter heated to 195–200° C. and maintained at that temperature for a period of hours.) The mixture is then filtered through diatomaceous earth and the filtrate is the desired product. The filtrate contains 8.40% phosphorous (8.7% theory) and 8.4% sulfur (8.50% theory).

Triphenylthiophosphate is sold by Ciba-Geigy under the trade name Irgalube TPPT™. Other suitable monothiophosphates include tricresylthiophosphate, tri-p-dodecylphenylthiophosphate, trioctylthiophosphate, tri-p-t-butylphenylthiophosphate, tri-β-naphthylthiophosphate, trilaurylthiophosphate, tri-p-heptylphenylthiophosphate, thiophosphates based on sulfur-coupled alkylphenols.

Dispersant

The lubricating composition, concentrates, and grease may also contain at least one dispersant, at least one borated overbased salt of an acidic organic compound, or a mixture of two or more thereof. In one embodiment, the dispersant contains boron. The dispersants include acylated amines, carboxylic esters, Mannich reaction products, hydrocarbyl substituted amines, and mixtures thereof The acylated amines include reaction products of one or more carboxylic acylating agent and one or more of the above amines. Preferably the amines are polyamines, such as alkylenepolyamines or condensed amines.

The carboxylic acylating agents include fatty acids, isoaliphatic acids, dimer acids, addition dicarboxylic acids, trimer acids, addition tricarboxylic acids, and hydrocarbyl substituted carboxylic acylating agents. In one embodiment, the carboxylic acylating agent is a fatty acid.

In another embodiment, the carboxylic acylating agents include isoaliphatic acids. Such acids contain a principal saturated, aliphatic chain typically having from about 14 to about 20 carbon atoms and at least one, but usually no more than about four, pendant acyclic lower alkyl groups. Specific examples of such isoaliphatic acids include 10-methyl-tetradecanoic acid, 3-ethyl-hexadecanoic acid, and 8-methyl-octadecanoic acid. The isoaliphatic acids include branched-chain acids prepared by oligomerization of commercial fatty acids, such as oleic, linoleic and tall oil fatty acids.

The dimer acids include products resulting from the dimerization of unsaturated fatty acids and generally contain an average from about 18 to about 44, or from about 28 to about 40 carbon atoms. Dimer acids are described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference.

In another embodiment, the carboxylic acylating agents are addition carboxylic acylating agents, which are addition (4+2 and 2+2) products of an unsaturated fatty acid, such as tall oil acids and oleic acids, with one or more unsaturated carboxylic reagents, which are described below. These acids are taught in U.S. Pat. No. 2,444,328, the disclosure of which is incorporated herein by reference.

In another embodiment, the carboxylic acylating agent is a tricarboxylic acylating agent. Examples of tricarboxylic acylating agents include trimer acylating agents and the reaction product of an unsaturated carboxylic acylating agent (such as unsaturated fatty acids) and an alpha,beta-unsaturated dicarboxylic acylating agent (such as maleic, itaconic, and citraconic acylating agents, preferably maleic acylating agents). These acylating agents generally contain an average from about 18, or about 30, or about 36 to about 66, or to about 60 carbon atoms. The trimer acylating agents are prepared by the trimerization of one or more fatty acids.

In one embodiment, the tricarboxylic acylating agent is the reaction product of one or more unsaturated carboxylic acylating agent, such as an unsaturated fatty acid or unsaturated alkenyl succinic anhydride and an alpha,beta-unsaturated carboxylic reagent. The unsaturated carboxylic reagents include unsaturated carboxylic acids per se and functional derivatives thereof, such as anhydrides, esters, amides, imides, salts, acyl halides, and nitriles. The unsaturated carboxylic reagent include mono, di, tri or tetracarboxylic reagents. Specific examples of useful monobasic unsaturated carboxylic acids are acrylic acid, methacrylic acid, cinnamic acid, crotonic acid, 2-phenylpropenoic acid, etc. Exemplary polybasic acids include maleic acid, maleic anhydride, fumaric acid, mesaconic acid, itaconic acid and citraconic acid. Generally, the unsaturated carboxylic reagent is maleic anhydride, acid or lower ester, e.g. those containing less than eight carbon atoms. In one embodiment, the unsaturated dicarboxylic acylating agent generally contains an average from about 12 up to about 40, or from about 18 up to about 30 carbon atoms. Examples of these tricarboxylic acylating agents include Empol® 1040 available commercially from Emery Industries, Hystrene® 5460 available commercially from Humko Chemical, and Unidyme® 60 available commercially from Union Camp Corporation.

In another embodiment, the carboxylic acylating agent is a hydrocarbyl substituted carboxylic acylating agent. The hydrocarbyl substituted carboxylic acylating agents are prepared by a reaction of one or more olefin or polyalkene with one or more of the above described unsaturated carboxylic reagents. The hydrocarbyl group generally contains from about 8 to about 300, or from about 12 up to about 200, or from about 16 up to about 150, or from about 30 to about 100 carbon atoms. In one embodiment, the hydrocarbyl group contains from about 8 up to about 40, or from about 10 up to about 30, or from about 12 up to about 24 carbon atoms. In one embodiment, the hydrocarbyl group may be derived from an olefin. The olefins typically contain from about 3 to about 40, or from about 4 to about 24 carbon atoms. These olefins are preferably alpha-olefins (sometimes referred to as mono-1-olefins or terminal olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available alpha-olefin fractions that can be used include the $C_{15-18}$ alpha-olefins, $C_{12-16}$ alpha-olefins, $C_{14-16}$ alpha-olefins, $C_{14-18}$ alpha-olefins, $c_{16-18}$ alpha-olefins, $C_{16-20}$ alpha-olefins, $C_{18-24}$ alpha-olefins, $C_{22-28}$ alph-olefins, etc.

In another embodiment, the hydrocarbyl group is derived from a polyalkene. The polyalkene includes homopolymers and interpolymers of polymerizable olefin monomers having from 2 up to about 16, or from 2 up to about 6, or from 2 to about 4 carbon atoms. The olefins may be monoolefins, such as ethylene, propylene, 1-butene, isobutylene, and 1-octene, or polyolefinic monomers, including diolefinic monomers, such 1,3-butadiene and isoprene. The olefins also may be one or more of the above described alpha-olefins. In one embodiment, the interpolymer is a homopolymer. In one embodiment, the homopolymer is a polybutene, such as a polybutene in which about 50% of the polymer is derived from butylene. The polyalkenes are prepared by conventional procedures. In one embodiment, the polyalkene is characterized as containing from about 8 up to about 300, or from about 30 up to about 200, or from about 35 up to about 100 carbon atoms. In one embodiment, the polyalkene is characterized by a Mn (number average molecular weight) of at least about 400 or at least about 500. Generally, the polyalkene is characterized by having an Mn from about 500 up to about 5000, or from about 700 up to about 3000, or from about 800 up to 2500, or from about 900 up to about 2000. In another embodiment, Mn varies from about 500 up to about 1500, or from about 700 up to about 1300, or from about 800 up to about 1200.

The abbreviation Mn is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC. The techniques for determining Mn and Mw values of polymers are well known and are described in numerous books and articles. For example, methods for the determination of Mn and molecular weight distribution of polymers is described in W. W. Yan, J. J. Kirkland and D. D. Bly, "Modern Size Exclusion Liquid Chromatographs", J. Wiley & Sons, Inc., 1979.

In another embodiment, the polyalkenes have a Mn from at least about 1300, or from about 1500, or from about 1700. In one embodiment, the polyalkenes have a Mn from about 1500 up to about 3200, or from about 1500 up to about 2800, or from about 1500 up to about 2400. In a preferred embodiment, the polyalkene has a Mn from about 1700 to about 2400. The polyalkenes also generally have a Mw/Mn from about 1.5 to about 4, or from about 1.8 to about 3.6, or from about 2.0 to about 3.4. The hydrocarbyl substituted carboxylic acylating agents are described in U.S. Pat. 3,219,666 and 4,234,435, the disclosures of which is hereby incorporated by reference.

The acylating agents may be prepared by reacting one or more of the above described polyalkenes with an excess of maleic anhydride to provide substituted succinic acylating agents wherein the number of succinic groups for each equivalent weight of substituent group, i.e., polyalkenyl group, is at least about 1.3, preferably at least about 1.4, or more preferably at least about 1.5. The maximum number will generally not exceed about 4.5, or preferably about 3.5. A suitable range is from about 1.4 up to about 3.5, or from about 1.5 up to about 2.5 succinic groups per equivalent weight of substituent groups.

The carboxylic acylating agents are known in the art and have been described in detail, for example, in the following: U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. 1,440,219. The disclosures of these patents are hereby incorporated by reference. These patents are incorporated herein by reference for their disclosure of carboxylic acylating agents and methods for making the same.

In another embodiment, the dispersant may also be a carboxylic ester. The carboxylic ester is prepared by reacting at least one or more of the above carboxylic acylating agents, preferably a hydrocarbyl substituted carboxylic acylating agent, with at least one organic hydroxy compound and optionally an amine. In another embodiment, the carboxylic ester dispersant is prepared by reacting the acylating agent with at least one of the above-described hydroxyamines.

The organic hydroxy compound includes compounds of the general formula $R''(OH)_m$ wherein R" is a monovalent or polyvalent organic group joined to the —OH groups through a carbon bond, and m is an integer from 1 to about 10 wherein the hydrocarbyl group contains at least about 8 aliphatic carbon atoms. The hydroxy compounds may be aliphatic compounds, such as monohydric and polyhydric alcohols, or aromatic compounds, such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived generally contain up to about 40 carbon atoms, or from 2 to about 30, or from 2 to about 10. They may be monohydric alcohols, such as methanol, ethanol, isooctanol, dodecanol, cyclohexanol, etc. The hydroxy compounds may also be polyhydric alcohols, such as alkylene polyols. In one embodiment, the polyhydric alcohols contain from 2 to about 40 carbon atoms, from 2 to about 20; and from 2 to about 10 hydroxyl groups, or from 2 to about 6. Polyhydric alcohols include ethylene glycols, including di-, tri- and tetra-ethylene glycols; propylene glycols, including di-, tri- and tetrapropylene glycols; glycerol; butanediol; hexanediol; sorbitol; arabitol; mannitol; trimethylolpropane; sucrose; fructose; glucose; cyclohexanediol; erythritol; and pentaerythritols, including di- and tripentaerythritol.

The polyhydric alcohols may be esterified with monocarboxylic acids having from 2 to about 30 carbon atoms, or from about 8 to about 18, provided that at least one hydroxyl group remains unesterified. Examples of monocarboxylic acids include acetic, propionic, butyric and above described fatty acids. Specific examples of these esterified polyhydric alcohols include sorbitol oleate, including mono- and dioleate, sorbitol stearate, including mono- and distearate, glycerol oleate, including glycerol mono-, di- and trioleate and erythritol octanoate.

The carboxylic ester dispersants may be prepared by any of several known methods. The method which is preferred because of convenience and the superior properties of the esters it produces, involves the reaction of the carboxylic acylating agents described above with one or more alcohol or phenol in ratios from about 0.5 equivalent to about 4 equivalents of hydroxy compound per equivalent of acylating agent. The esterification is usually carried out at temperatures above about 100° C., or between 150° C. and 300° C. The water formed as a by-product is removed by distillation as the esterification proceeds. The preparation of useful carboxylic ester dispersant is described in U.S. Pat. Nos. 3,522,179 and 4,234,435, and their disclosures are incorporated by reference.

The carboxylic ester dispersants may be further reacted with at least one of the above described amines and preferably at least one of the above described polyamines, such as a polyethylenepolyamine or a heterocyclic amine, such as aminopropylmopholine. The amine is added in an amount sufficient to neutralize any nonesterified carboxyl groups. In one embodiment, the carboxylic ester dispersants are prepared by reacting from about 1 to about 2 equivalents, or from about 1.0 to 1.8 equivalents of hydroxy compounds, and up to about 0.3 equivalent, or from about 0.02 to about 0.25 equivalent of polyamine per equivalent of acylating agent. The carboxylic acid acylating agent may be reacted simultaneously with both the hydroxy compound and the amine. There is generally at least about 0.01 equivalent of the alcohol and at least 0.01 equivalent of the amine although the total amount of equivalents of the combination should be at least about 0.5 equivalent per equivalent of acylating agent. These carboxylic ester dispersant compositions are known in the art, and the preparation of a number of these derivatives is described in, for example, U.S. Pat. Nos. 3,957,854 and 4,234,435 which have been incorporated by reference previously.

In another embodiment, the dispersant may also be a hydrocarbyl-substituted amine. These hydrocarbyl-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same. Typically, hydrocarbyl substituted amines are prepared by reacting olefins and olefin polymers, including the above polyalkenes and halogenated derivatives thereof, with mamines (mono- or polyamines). The amines may be any of the amines described above, preferably an alkylene-polyamine. Examples of hydrocarbyl substituted amines include poly(propylene)amine; N,N-dimethyl-N-poly (ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene)ethylenediamine; N-poly(propylene) trimetbylenediamine; N-poly(butene)diethylenetriamine; N',N'-poly(butene)tetraethylenepentamine; N,N-dimethyl-N'-poly(propylene)-1,3-propylenediamine and the like.

In another embodiment, the dispersant may also be a Mannich dispersant. Mannich dispersants are generally formed by the reaction of at least one of the above described aldehydes, such as formaldehyde and paraformaldehyde, at least one of the above described amines and at least one alkyl substituted hydroxyaromatic compound. The reaction may occur from room temperature to about 225° C., or from about 50° to about 200° C., or from about 75° C. to about 150° C. The amounts of the reagents is such that the molar ratio of hydroxyaromatic compound to formaldehyde to amine is in the range from about (1:1:1) to about (1:3:3).

The first reagent is an alkyl substituted hydroxyaromatic compound. This term includes the above described phenols. The hydroxyaromatic compounds are those substituted with at least one, and preferably not more than two, aliphatic or alicyclic groups having from about 6 up to about 400, or from about 30 up to about 300, or from about 50 up to about 200 carbon atoms. These groups may be derived from one or more of the above described olefins or polyalkenes. In one embodiment, the hydroxyaromatic compound is a phenol substituted with an aliphatic or alicyclic hydrocarbon-based group having an $\overline{M}n$ of about 420 to about 10,000.

The third reagent is any amine described above. Preferably the amine is one or more of the above described polyamines, such as the polyalkylenepolyamines. Mannich dispersants are described in the following patents: U.S. Pat. No. 3,980,569; U.S. Pat. No. 3,877,899; and U.S. Pat. No. 4,454,059 (herein incorporated by reference for their disclosure to Mannich dispersants).

In another embodiment, the dispersant is a borated dispersant. The borated dispersants are prepared by reacting one or more of the above disperants with at least one boron compound. The boron compounds include boron oxide, boron oxide hydrate, boron trioxide, boron acids, such as boronic acid (i.e., alkyl-$B(OH)_2$ or aryl-$B(OH)_2$), including methyl boronic acid, phenyl-boronic acid, cyclohexyl boronic acid, p-heptylphenyl boronic acid and dodecyl boronic acid, boric acid (i.e., $H_3BO_3$), tetraboric acid (i.e., $H_2B_4O_7$), metaboric acid (i.e., $HBO_2$), boron anhydrides, boron amides and various esters of such boron acids.

In one embodiment, the boron compounds include mono-, di-, and tri-organic esters of boric acid and alcohols or phenols. Examples of the alcohols include methanol, ethanol, propanol, butanol, 1-octanol, benzyl alcohol, ethylene glycol, glycerol, and Cellosolve. Lower alcohols, having less than about 8 carbon atoms, and glycols, such as 1,2-glycols and 1,3-glycols, are especially useful. Methods for preparing the esters are known and disclosed in the art (such as "Chemical Reviews," pp. 959–1064, Vol. 56).

Typically, the borated dispersant contains from about 0.1% up to about 5%, or from about 0.5% up to about 4%, or from 0.7% up to about 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662 and 4,925,983. These references are incorporated by reference for their disclosure of borated dispersants.

The following examples relate to dispersants useful in the present invention.

EXAMPLE B-1

(a) An acylated nitrogen composition is prepared by reacting 3880 grams of the polyisobutenyl succinic anhydride, 376 grams of a mixture of triethylenetetramine and diethylenetriamine (75:25 weight ratio), and 2785 grams of mineral oil in toluene at 150° C. The product is vacuum stripped to remove toluene.

(b) A mixture of 62 grams (1 atomic proportion of boron) of boric acid and 1645 grams (2.35 atomic proportions of nitrogen) of the acylated nitrogen composition obtained from B-1(a) is heated at 150° C. in nitrogen atmosphere for 6 hours. The mixture is then filtered and the filtrate is found to have a nitrogen content of 1.94% and a boron content of 0.33%.

EXAMPLE B-2

A mixture of 372 grams (6 atomic proportions of boron) of boric acid and 3111 grams (6 atomic proportions of nitrogen) of a acylated nitrogen composition, obtained by reacting 1 equivalent of a polybutenyl ($\overline{M}n$=850) succinic anhydride, having an acid number of 113 (corresponding to an equivalent weight of 500), with 2 equivalents of a commercial ethylene amine mixture having an average composition corresponding to that of tetraethylenepentamine, is heated at 150° C. for 3 hours and then filtered. The filtrate is found to have a boron content of 1.64% and a nitrogen content of 2.56%.

EXAMPLE B-3

Boric acid (124 grams, 2 atomic proportions of boron) is added to the acylated nitrogen composition (556 grams, 1 atomic proportion of nitrogen) of Example B-2. The resulting mixture is heated at 150° C. for 3.5 hours and filtered at that temperature. The filtrate is found to have a boron compound of 3.23% and a nitrogen content of 2.3%.

EXAMPLE B-4

(a) A reaction vessel is charged with 1000 parts of a polybutenyl ($\overline{M}n$=1000 substituted succinic anhydride having a total acid number of 108 with a mixture of 275 grams of oil and 139 parts of a commercial mixture of polyamines corresponding to 85% E-100 amine bottoms and 15% diethylenetriamine. The reaction mixture is heated to 150 to 160° C. and held for four hours. The reaction is blown with nitrogen to remove water.

(b) A reaction vessel is charged with 1405 parts of the product of Example B-4(a), 229 parts of boric acid, and 398 parts of diluent oil. The mixture is heated to 100 to 150° C. and the temperature maintained until water is removed. The final product contains 2.3% nitrogen, 1.9% boron, 33% 100 neutral mineral oil and a total base number of 60.

As described above the lubricating compositions, concentrates and grease additionally contain at least one overbased composition or at least one phosphorus or boron compound, or mixtures of two or more thereof. In one embodiment, (B) is an overbased metal salt and is present in an amount from about 0.5% to about 4%, or from about 0.7% to about 3%, or from about 0.9% to about 2% by weight of the lubricating composition.

Overbased Metal Compositions

Overbased metal compositions are characterized by having a metal content in excess of that which would be present according to the stoichiometry of the metal and the acidic organic compound. The amount of excess metal is commonly expressed in metal ratio. The term "metal ratio" is the ratio of the total equivalents of the metal to the equivalents of the acidic organic compound. A salt having a metal ratio of 4.5 will have 3.5 equivalents of excess metal. The overbased salts generally have a metal ratio from about 1.5 up to about 40, or from about 2 up to about 30, or from about 3 up to about 25. In one embodiment, the metal ratio is greater than about 7, or greater than about 10, or greater than about 15.

The overbased materials are prepared by reacting an acidic material, typically carbon dioxide, with a mixture comprising an acidic organic compound, a reaction medium comprising at least one inert, organic solvent for the acidic organic compound, a stoichiometric excess of a basic metal compound, and a promoter. Generally, the basic metal compounds are oxides, hydroxides, chlorides, carbonates, and phosphorus acids (phosphonic or phosphoric acid) salts, and sulfur acid (sulfuric or sulfonic) salts. The metals of the basic metal compounds are generally alkali, alkaline earth, and transition metals. Examples of the metals of the basic metal compound include sodium, potassium, lithium, magnesium, calcium, barium, titanium, manganese, cobalt, nickel, copper, and zinc, preferably sodium, potassium, calcium, and magnesium.

The acidic organic compounds useful in making the overbased compositions of the present invention include carboxylic acylating agents, sulfonic acids, phosphorus—containing acids, phenols, or mixtures of two or more thereof. Preferably, the acidic organic compounds are carboxylic acylating agents, sulfonic acids, or phenate. In one embodiment, the carboxylic acylating agent are described above, such as the hydrocarbyl substituted carboxylic acylating agents.

In another embodiment, the carboxylic acylating agent is an alkylalkyleneglycol-acetic acid, or alkylpolyethyleneglycol-acetic acid. Some specific examples of these compounds include: iso-stearylpentaethyleneglycol-acetic acid;

iso-stearyl-O—$(CH_2CH_2O)_5CH_2CO_2Na$; lauryl-O—$(CH_2CH_2O)_{2.5}$—$CH_2CO_2H$; lauryl-O—$(CH_2CH_2O)_{3.3}CH_2CO_2H$; oleyl-O—$(CH_2C$—$H_2O)_4$—$CH_2CO_2H$; lauryl-O—$(CH_2CH_2O)_{4.5}CH_2CO_2H$; lauryl-O—$(CH_2CH_2O)$—$_4CH_2CO_2H$; lauryl-O—$(CH_2CH_2O)_{16}CH_2CO_2H$; octyl-phenyl-O—$(CH_2CH_2O)_8CH_2CO_2H$; octyl-phenyl-O—$(CH_2CH_2O)_{19}CH_2CO_2H$; 2-octyl-decanyl-O—$(CH_2CH_2O)_6CH_2O)_6CH_2CO_2H$. These acids are available commercially from Sandoz Chemical Co. under the tradename of Sandopan acids.

In another embodiment, the carboxylic acylating agents are aromatic carboxylic acids. A group of useful aromatic carboxylic acids are those of the formula

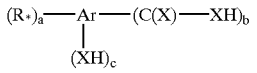

wherein R* is an aliphatic hydrocarbyl group having from about 4 to about 400 carbon atoms, a is a number in the range of zero to about 4, Ar is an aromatic group, each X is independently sulfur or oxygen, preferably oxygen, b is a number in the range from one to about four, c is a number in the range of zero to about four, usually one or two, with the proviso that the sum of a, b and c does not exceed the number of valences of Ar. In one embodiment, R* and a are such that there is an average of at least about eight aliphatic carbon atoms provided by the R* groups.

The aromatic group as represented by "Ar", as well as elsewhere in other formulae in this specification and in the appended claims, may be mononuclear or polynuclear. Examples of mononuclear Ar moieties include benzene moieties, such as 1,2,4-benzenetriyl; 1,2,3-benezenetriyl; 3-methyl-1,2,4-benzenetriyl; 2-methyl-5-ethyl-1,3,4-benzenetriyl; 3-propoxy-1,2,4,5-benzenetetrayl; 3-chloro-1,2,4-benzenetriyl; 1,2,3,5-benzenetetrayl; 3-cyclohexyl-1,2,4-benzenetriyl; and 3-azocyclopentyl-1,2,5-benzenetriyl, and pyridine moieties, such as 3,4,5-azabenzene; and 6-methyl-3,4,5-azabenzene. The polynuclear groups may be those where an aromatic nucleus is fused at two points to another aromatic nucleus, such as naphthyl and anthracenyl groups. Specific examples of fused ring aromatic moieties Ar include: 1,4,8-naphthylene; 1,5,8-naphthylene; 3,6-dimethyl-4,5,8(1-azonaphthalene); 7-methyl-9-methoxy-1,2,5, 9-anthracenetetrayl; 3,10-phenathrylene; and 9-methoxy-benz(a)phenanthrene-5,6,8,12-yl. The polynuclear group may those where at least two nuclei (either mononuclear or polynuclear) are linked through bridging linkages. These bridging linkages may be chosen from the group consisting of alkylene linkages, ether linkages, keto linkages, sulfide linkages, and polysulfide linkages of 2 to about 6 sulfur atoms. Specific examples of Ar when it is linked polynuclear aromatic moiety include: 3,3',4,4',5-bisbenzenetetrayl; di(3,4-phenylene)ether; 2,3-phenylene-2,6-naphthylenemethane; and 3-methyl,9H-fluorene-1,2,4,5,8-yl; 2,2-di(3,4-phenylene)propane; sulfur-coupled 3-methyl-1,2,4-benzatriyl (having 1 to about 10 thiomethylphenylene groups); and amino-coupled 3-methyl-1,2,4-benzatriyl (having 1 to about 10 aminomethylphenylene groups). Typically Ar is a benzene nucleus, lower alkylene bridged benzene nucleus, or a naphthalene nucleus.

The R* group is a hydrocarbyl group that is directly bonded to the aromatic group Ar. R* typically contains from about 6 to about 80, preferably from about 7 to about 30, preferably from about 8 to about 25, preferably from about 8 to about 15 carbon atoms. Examples of R* groups include butyl, isobutyl, pentyl, octyl, nonyl, dodecyl, 5-chlorohexyl, 4-ethoxypentyl, 3-cyclohexyloctyl, 2,3,5-trimethylheptyl, propylene tetramer, triisobutenyl and substituents derived from one of the above described olefins or polyalkenes.

Within this group of aromatic acids, a useful class of carboxylic acids are those of the formula

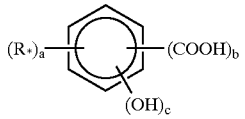

wherein R* is defined above, a is a number in the range of from zero to about 4, or from 1 to about 3; b is a number in the range of 1 to about 4, or from 1 to about 2, c is a number in the range of zero to about 4, or from 1 to about 2, and or 1; with the proviso that the sum of a, b and c does not exceed 6. In one embodiment, R* and a are such that the acid molecules contain at least an average of about 12 aliphatic carbon atoms in the aliphatic hydrocarbon substituents per acid molecule. Typically, b and c are each one and the carboxylic acid is a salicylic acid.

In one embodiment, the salicylic acids are hydrocarbyl substituted salicylic acids, wherein each hydrocarbyl substituent contains an average of at least about 8 carbon atoms per substituent and 1 to 3 substituents per molecule. In one embodiment, the hydrocarbyl substituent is derived from one or more above-described polyalkenes.

The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

In another embodiment, the acidic organic compound is a sulfonic acid. The sulfonic acids include sulfonic and thiosulfonic acids, preferably sulfonic acids. The sulfonic acids include the mono- or polynuclear aromatic or cycloaliphatic compounds. The oil-soluble sulfonic acids may be represented for the most part by one of the following formulae: $R_{\#}$-T—$(SO_3)_aH$ and $R_{+}$—$(SO_3)_bH$, wherein T is a cyclic nucleus such as benzene, naphthalene, anthracene, diphenylene oxide, diphenylene sulfide, and petroleum naphthenes; $R_{190}$ is an aliphatic group such as alkyl, alkenyl, alkoxy, alkoxyalkyl, etc.; $(R_{\#})$+T contains a total of at least about 15 carbon atoms; and $R_{+}$ is an aliphatic hydrocarbyl group containing at least about 15 carbon atoms. Examples of $R_{+}$ are alkyl, alkenyl, alkoxyalkyl, carboalkoxyalkyl, etc. Specific examples of $R_{+}$ are groups derived from petrolatum, saturated and unsaturated paraffin wax, and one or more of the above-described polyalkenes. The groups T, $R_{\#}$, and $R_{+}$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least one.

A preferred group of sulfonic acids are mono-, di-, and tri-alkylated benzene and naphthalene sulfonic acids including their hydrogenated forms. Illustrative of synthetically produced alkylated benzene and naphthalene sulfonic acids are those containing alkyl substituents having from about 8 to about 30 carbon atoms, or from about 10 to about 30 carbon atoms, or from about 12 up to about 24 carbon atoms. Specific examples of sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and polywax-substituted sulfonic acids; alkylbenzene sulfonic acids (where the alkyl group has at least 8 carbons), dilaurylbeta-naphthyl sulfonic acids, and alkaryl sulfonic acids, such as dodecylbenzene "bottoms" sulfonic acids.

Dodecylbenzene "bottoms" sulfonic acids are the material leftover after the removal of dodecylbenzene sulfonic acids that are used for household detergents. The "bottoms" may be straight-chain or branched-chain alkylates with a straight-chain dialkylate preferred. The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

In another embodiment, the acidic organic compound is a phosphorus containing acid. The phosphorus containing acids are one or more of the above described phosphorus containing acids. In one embodiment, the phosphorus—containing acid is the reaction product of one or more of the above polyalkenes and a phosphorus sulfide. Useful phosphorus sulfide sources include phosphorus pentasulfide, phosphorus sesquisulfide, phosphorus heptasulfide and the like. The reaction of the polyalkene and the phosphorus sulfide generally may occur by simply mixing the two at a temperature above 80° C., or from about 100° C. to about 300° C. Generally, the products have a phosphorus content from about 0.05% to about 10%, or from about 0.1% to about 5%. The relative proportions of the phosphorizing agent to the olefin polymer is generally from 0.1 part to 50 parts of the phosphorizing agent per 100 parts of the olefin polymer. The phosphorus containing acids are described in U.S. Pat. No. 3,232,883, issued to LeSuer. This reference is herein incorporated by reference for its disclosure to the phosphorus containing acids and methods for preparing the same.

In another embodiment, the acidic organic compound is a phenol. The phenols may be represented by the formula $(R^*)_a$—Ar—$(OH)_b$, wherein R* is defined above; Ar is an aromatic group as described above; a and b are independently numbers of at least one, the sum of a and b being in the range of two up to the number of displaceable hydrogens on the aromatic nucleus or nuclei of Ar, which is defined above. In one embodiment, a and b are each independently numbers in the range from one to about four, or from one to about two. In one embodiment, R* and a are such that there is an average of at least about eight aliphatic carbon atoms provided by the R* groups for each phenol compound.

Promoters are often used in preparing the overbased metal salts. The promoters, that is, the materials which facilitate the incorporation of the excess metal into the overbased material, are also quite diverse and well known in the art. A particularly comprehensive discussion of suitable promoters is found in U.S. Pat. Nos. 2,777,874, 2,695,910, 2,616,904, 3,384,586 and 3,492,231. These patents are incorporated by reference for their disclosure of promoters. In one embodiment, promoters include the alcoholic and phenolic promoters. The alcoholic promoters include the alkanols of one to about 12 carbon atoms, such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Acidic materials, which are reacted with the mixture of acidic organic compound, promoter, metal compound and reactive medium, are also disclosed in the above cited patents, for example, U.S. Pat. No. 2,616,904. Those disclosures are incorporated by reference for their disclosure of such acidic materials. Included within the known group of useful acidic materials are liquid acids, such as formic acid, acetic acid, nitric acid, boric acid, sulfuric acid, hydrochloric acid, hydrobromic acid, carbamic acid, substituted carbamic acids, etc. Acetic acid is a very useful acidic material although inorganic acidic compounds such as HCI, $SO_2$, $SO_3$, $CO_2$, $H_2S$, $N_2O_3$, etc., are ordinarily employed as the acidic materials. Particularly useful acidic materials are carbon dioxide and acetic acid.

The methods for preparing the overbased materials, as well as overbased materials, are known in the prior art and are disclosed, for example, in the following U.S. Pat. Nos.: 2,616,904; 2,616,905; 2,616,906; 3,242,080; 3,250,710; 3,256,186; 3,274,135; 3,492,231; and 4,230,586. These patents disclose processes, materials, which can be overbased, suitable metal bases, promoters, and acidic materials, as well as a variety of specific overbased products useful in producing the overbased systems of this invention and are, accordingly, incorporated herein by reference for these disclosures.

The temperature at which the acidic material is contacted with the remainder of the reaction mass depends to a large measure upon the promoting agent used. With a phenolic promoter, the temperature usually ranges from about 80° C. to about 300° C., and preferably from about 100° C. to about 200° C. When an alcohol or mercaptan is used as the promoting agent, the temperature usually will not exceed the reflux temperature of the reaction mixture and preferably will not exceed about 100° C.

In one embodiment, the overbased metal salts are borated overbased metal salts. The borated overbased metals salts are prepared by reacting one or more of the above overbased metals salts with one or more of the above boron compounds. The borated overbased metal salts generally contains from about 0.1% up to about 15%, or from about 0.5% up to about 10%, or from about 1% up to about 8% by weight of the boron. Borated overbased compositions, lubricating compositions containing the same and methods of preparing borated overbased compositions are found in U.S. Pat. No. 4,744,920, issued to Fischer et al; U.S. Pat. No. 4,792,410, issued to Schwind et al, and PCT Publication WO 88/03144. The disclosures relating to the above are hereby incorporated by reference.

The following examples relate to borated overbased metal salts and methods of making the same. Unless the context indicates otherwise, here as well as elsewhere in the specification and claims, parts and percentages are by weight, temperature is in degrees Celsius and pressure is atmospheric pressure.

EXAMPLE B-5

(a) A mixture of 853 grams of methyl alcohol, 410 grams of blend oil, 54 grams of sodium hydroxide, and a neutralizing amount of additional sodium hydroxide is prepared. The amount of the latter addition of sodium hydroxide is dependent upon the acid number of the subsequently added sulfonic acid. The temperature of the mixture is adjusted to 49° C. 1070 grams of a mixture of straight chain dialkyl benzene sulfonic acid ($\overline{M}w$=430) and blend oil (42% by weight active content) are added while maintaining the temperature at 49–57° C. 145 grams of polyisobutenyl (number average $\overline{M}n$=950)-substituted succinic anhydride are added. 838 grams of sodium hydroxide are added. The temperature is adjusted to 71° C. The reaction mixture is blown with 460 grams of carbon dioxide. The mixture is flash stripped to 149° C., and filtered to clarity to provide the desired product. The product is an overbased sodium sulfonate having a base number (bromophenol blue) of 440, a metal content of 19.45% by weight, a metal ratio of 20, a sulfate ash content of 58% by weight, and a sulfur content of 1.35% by weight.

(b) A mixture of 1000 grams of the product from Example B-5(a) above, 0.13 gram of an antifoaming agent (kerosene solution of Dow Corning 200 Fluid having a viscosity of 1000 cSt at 25° C), and 133 grams of blend oil is heated to 74–79° C. with stirring. 486 grams of boric acid are added. The reaction mixture is heated to 121° C. to liberate water of reaction and 40–50% by weight of the $CO_2$ contained in the product from Example 1(a). The reaction mixture is heated to 154–160° C. and maintained at that temperature until the free and total water contents are reduced to 0.3% by weight or less and approximately 1–2% by weight, respectively. The reaction product is cooled to room temperature and filtered. The filtrate has 6.1% boron, 14.4% sodium, and 35% 100 neutral mineral oil.

EXAMPLE B-6

(a) A mixture of 1000 grams of a primarily branched chain monoalkylbenzene sulfonic acid ($\overline{M}w$=500), 771 grams of o-xylene, and 75.2 grams of polyisobutenyl (number average $\overline{M}n$=950) succinic anhydride is prepared and the temperature is adjusted to 46° C. 87.3 grams of magnesium oxide are added. 35.8 grams of acetic acid are added. 31.4 grams of methyl alcohol and 59 grams of water are added. The reaction mixture is blown with 77.3 grams of carbon dioxide at a temperature of 49–54° C. 87.3 grams of magnesium oxide, 31.4 grams of methyl alcohol and 59 grams of water are added, and the reaction mixture is blown with 77.3 grams of carbon dioxide at 49–54° C. The foregoing steps of magnesium oxide, methyl alcohol and water addition, followed by carbon dioxide blowing are repeated once. O-xylene, methyl alcohol and water are removed from the reaction mixture using atmospheric and vacuum flash stripping. The reaction mixture is cooled and filtered to clarity. The product is an overbased magnesium sulfonate having a base number (bromophenol blue) of 400, a metal content of 9.3% by weight, a metal ratio 14.7, a sulfate ash content of 46.0%, and a sulfur content of 1.6% by weight.

(b) A mixture of 1000 grams of the product from Example B-6(a) and 181 grams of diluent oil is heated to 79° C. Boric acid (300 grams) is added and the reaction mixture is heated to 124° C. over a period of 8 hours. The reaction mixture is maintained at 121–127° C. for 2–3 hours. A nitrogen sparge is started and the reaction mixture is heated to 149° C. to remove water until the water content is 3% by weight or less. The reaction mixture is filtered to provide the desired product. The product contains 7.63% magnesium and 4.35% boron.

EXAMPLE B-7

(a) A reaction vessel is charged with 281 parts (0.5 equivalent) of a polybutenyl-substituted succinic anhydride derived from a polybutene ($\overline{M}n$=1000), 281 parts of xylene, 26 parts of tetrapropenyl substituted phenol and 250 parts of 100 neutral mineral oil. The mixture is heated to 80° C. and 272 parts (3.4 equivalents) of an aqueous sodium hydroxide solution are added to the reaction mixture. The mixture is blown with nitrogen at 1 scfh (standard cu. ft/hr) and the reaction temperature is increased to 148° C. The reaction mixture is then blown with carbon dioxide at 1 scfh for one hour and 25 minutes while 150 parts of water is collected. The reaction mixture is cooled to 80° C. where 272 parts (3.4 equivalents) of the above sodium hydroxide solution is added to the reaction mixture and the mixture is blown with nitrogen at 1 scfh. The reaction temperature is increased to 140° C. where the reaction mixture is blown with carbon dioxide at 1 scfh for 1 hour and 25 minutes while 150 parts of water is collected. The reaction temperature is decreased to 100° C. and 272 parts (3.4 equivalents) of the above sodium hydroxide solution is added while blowing the mixture with nitrogen at 1 scfh. The reaction temperature is increased to 148° C. and the reaction mixture is blown with carbon dioxide at 1 scfh for 1 hour and 40 minutes while 160 parts of water is collected. The reaction mixture is cooled to 90° C. and where 250 parts of 100 neutral mineral oil are added to the reaction mixture. The reaction mixture is vacuum stripped at 70° C. and the residue is filtered through diatomaceous earth. The filtrate contains 50.0% sodium sulfate ash (theoretical 53.8%) by ASTM D-874, total base number of 408, a specific gravity of 1.18 and 37.1% oil.

(b) A reaction vessel is charged with 700 parts of the product of Example B-7(a). The reaction mixture is heated to 75° C. where 340 parts (5.5 equivalents) of boric acid is added over 30 minutes. The reaction mixture is heated to 110° C. over 45 minutes and the reaction temperature is maintained for 2 hours. A 100 neutral mineral oil (80 parts) is added to the reaction mixture. The reaction mixture is blown with nitrogen at 1 scfh at 160° C. for 30 minutes while 95 parts of water is collected. Xylene (200 parts) is added to the reaction mixture and the reaction temperature is maintained at 130–140° C. for 3 hours. The reaction mixture is vacuum stripped at 150° C. and 20 millimeters of mercury. The residue is filtered through diatomaceous earth. The filtrate contains 5.84% boron (theoretical 6.43) and 33.1% oil. The residue has a total base number of 309.

Lubricants

As previously indicated, the combination of a organic polysulfide and the phosphorus compounds are useful as additives for lubricants in which they can function primarily as antiwear, antiweld, and/or extreme pressure agents. Lubricants containing this combination have improved properties such as those relating to odor, copper strip, thermal stability wear, scuffing, oxidation, surface fatigue, seal compatibility, corrosion resistance, and thermal durability. They may be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic or manual transmission fluids, transaxle lubricants, gear lubricants, including open and enclosed gear lubricants, tractor lubricants, metal-working lubricants, hydraulic fluids and other lubricating oil and grease compositions can also benefit from the incorporation therein of the compositions of the present invention. They may also be used as wirerope, walking cam, way, rock drill, chain and conveyor belt, worm gear, bearing, and rail and flange lubricants.

As described above, the lubricating composition contains an oil of lubricating viscosity. The oils of lubricating viscosity include natural or synthetic lubricating oils and mixtures thereof. Natural oils include animal oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Preferably, the oil of lubricating viscosity is a hydrotreated mineral oil or a synthetic lubricating oil, such as a polyolefin. Examples of useful oils of lubricating viscosity include XHVI basestocks, such as 100N isomerized wax basestock (0.01% sulfur/141 VI), 120N isomerized wax basestock (0.01% sulfur/149 VI), 170N isomerized wax basestock (0.01% sulfur/142 VI), and 250N isomerized wax basestock (0.01% sulfur/146 VI); refined basestocks, such as 250N solvent refined paraffinic mineral oil (0.16% sulfur/89 VI), 200N solvent refined naphthenic mineral oil (0.2% sulfur/60 VI), 100N solvent refined/hydrotreated paraffinic mineral oil (0.01% sulfur/98 VI), 240N solvent refined/hydrotreated paraffinic mineral oil (0.01% sulfur/98 VI), 80N solvent refined/hydrotreated paraffinic mineral oil (0.08% sulfur/127 VI), and 150N solvent refined/hydrotreated paraffinic mineral oil (0.17% sulfur/127 VI). A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity is a polyalpha-olefin (PAO). Typically, the polyalpha-olefins are derived from monomers having from about 4 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins.

In one embodiemnt, the lubricating composition contains an oil of lubricating viscosity which has an iodine value of less than about 9. Iodine value is determined according to ASTM D-460. In one embodiment, the oil of lubricating viscosity has a iodine value less than about 8, or less than about 6, or less than about 4.

In one embodiment, the oil of lubricating viscosity are selected to provide lubricating compositions with a kinematic viscosity of at least about 3.5 cSt, or at least about 4.0 cSt at 100° C. In one embodiment, the lubricating compositions have an SAE gear viscosity grade of at least about SAE 75W. The lubricating composition may also have a so-called multigrade rating such as SAE 75W-80, 75W-90, 75W-90, 75W-140, 80W-90, 80W-140, 85W-90, or 85W-140. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. In one embodiment, the viscosity improver is a polyolefin or polymethacrylate. Viscosity improvers available commercially include Acryloid™ viscosity improvers available from Rohm & Haas; Shellvis™ rubbers available from Shell Chemical; Trilene™ polymers, such as Trilene™ CP-40, available commercially from Uniroyal Chemical Co., and Lubrizol 3100 series and 8400 series polymers, such as Lubrizol 3174 available from The Lubrizol Corporation.

In one embodiment, the oil of lubricating viscosity includes at least one ester of a dicarboxylic acid. Typically the esters containing from about 4 to about 30, preferably from about 6 to about 24, or from about 7 to about 18 carbon atoms in each ester group. Here, as well as elsewhere, in the specification and claims, the range and ratio limits may be combined. Examples of dicarboxylic acids include glutaric, adipic, pimelic, suberic, azelaic and sebacic. Example of ester groups include hexyl, octyl, decyl, and dodecyl ester groups. The ester groups include linear as well as branched ester groups such as iso arrangements of the ester group. A particularly useful ester of a dicarboxylic acid is diisodecyl azelate.

Additional Additives

In one embodiment, the lubricating compositions and functional fluids contain one or more auxiliary extreme pressure and/or antiwear agents, corrosion inhibitors and/or oxidation inhibitors. Auxiliary extreme pressure agents and corrosion and oxidation inhibiting agents which may be included in the lubricants and functional fluids of the invention are exemplified by halogenated, e.g. chlorinated, aliphatic hydrocarbons such as chlorinated olefins or waxes; boron compounds, such as borated epoxides and amines, borated phospholipids, and borate esters of one or more of the above alcohols; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters (e.g. the reaction product of dibutylamine, carbon disulfide, and methyl acrylate); dithiocarbamate containing amides, prepared from dithiocarbamic acid and an acrylamide (e.g. the reaction product of dibutylamine, carbon disulfide, and acrylamide); alkylene-coupled dithiocarbamates (e.g. methylene or phenylene bis (dibutyldithiocarbamate); and sulfur-coupled dithiocarbamates (e.g. bis(S-alkyldithiocarbamoyl) disulfides). Many of the above-mentioned auxiliary extreme pressure agents and corrosion-oxidation inhibitors also serve as antiwear agents.

The lubricating compositions and functional fluids may contain one or more pour point depressants, color stabilizers, metal deactivators and/or anti-foam agents. Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

These additional additives, when used, are present in the inventive lubricating and functional fluid compositions at sufficient concentrations to provide the compositions with enhanced properties depending upon their intended use. For example, the pour point depressant are added at sufficient concentrations to provide the inventive compositions with enhanced pour point depressant characteristics, while the antifoam agents are added at sufficient concentrations to provide the inventive compositions with enhanced antifoaming characteristics. Generally, each of these additional additives are present in the lubricants and functional fluids at concentrations from about 0.01%, or from about 0.05%, or from about 0.5%. These additional additives are generally present in an amount up to about 10% by weight, or up to about 5% by weight, and or up to about 3% by weight.

In one embodiment, the lubricating compositons contain less than 2%, or less than 1.5%, or less than 1% by weight of a dispersant. In another embodiment, the lubricating compositions are free of lead based additives, metal (zinc) dithiophosphates, and alkali or alkaline earth metal borates.

In another embodiment, the combination of the organic polysulfide and the overbased composition or the phosphorus or boron compound may be used in concentrates. The concentrate may contain the above combination alone or with other components used in preparing fully formulated lubricants. The concentrate also contains at least one substantially inert organic diluent, which includes kerosene, mineral distillates, or one or more of the oils of lubricating viscosity discussed above. In one embodiment, the concentrates contain from about 0.01%, or from about 0.1%, or from about 1% up to about 70% or up to about 80%, even up to about 90% by weight of the combination. In one embodiment, the concentrates contain from 0.01% up to about 49.9%, or from about 0.1% up to about 45% by weight of the organic diluent.

The following examples relate to concentrates and lubricating compositons of the present invention.

EXAMPLE I

A gear lubricant is prepared by incorporating 3.5% of the product of Example S-1, and 1.3% of the product of example P-3, 0.5% by weight of dibutyl hydrogen phosphite, and 0.3% by weight of triphenylmonothiophosphate into a SAE SAE 90 lubricating oil mixture.

EXAMPLE II

A lubricant is prepared as described in Example I, except except 0.4% by eight of di($C_{1418}$) hydrogen phosphite is used in place of dibutyl hydrogen phosphite.

EXAMPLE III

A gear lubricant is prepared by incorporating 4% of the product of Example S-3, 1.2% by weight of Example P-6, 0.2% dioleyl phosphite, and 0.2% by weight of the product of Example P-9 into an SAE 80W-90 lubricating oil mixture.

EXAMPLE IV

A gear lubricant is prepared by incorporating 3.5% of the product of Example S-4, 0.75% of the product of Example P-3, 0.35% of dibutyl hydrogen phosphite, and 0.3% of the product of Example P-9 into an SAE 80W-90 lubricating oil mixture.

EXAMPLE V

A gear lubricant is prepared as described in Example IV except the lubricant additionally contains 1.2% of the product of Example B-6.

EXAMPLE VI

A lubricant is prepared as described in Example V except 1.1% of the product of Example B-4 replaces the product of Example B-6.

Greases

Where the lubricant is to be used in the form of a grease, the lubricating oil generally is employed in an amount sufficient to balance the total grease composition and, generally, the grease compositions will contain various quantities of thickeners and other additive components to provide desirable properties. The organic polysulfide is generally present in an amount from about 0.1% up to about 10%, or from about 0.5% up to about 5%by weight. The overbased composition or the phosphorus or boron compound is generally present in an amount from about 0.1% up to about 8%, or from about 0.5% up to about 6% by weight.

A wide variety of thickeners can be used in the preparation of the greases of this invention. The thickener is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, stearic, oleic acid, palmitic acid, myristic acid, cottonseed oil acids, and hydrogenated fish oils.

Other thickeners include salt and salt-soap complexes, such as calcium stearate-acetate (U.S. Pat. No. 2,197,263), barium stearate-acetate (U.S. Pat. No. 2,564,561), calcium stearate-caprylate-acetate complexes (U.S. Pat. No. 2,999,066), calcium salts and soaps of low-intermediate- and high-molecular weight acids and of nut oil acids, aluminum stearate, and aluminum complex thickeners. Useful thickeners include hydrophilic clays which are treated with an ammonium compound to render them hydrophobic. Typical ammonium compounds are tetraalkyl ammonium chlorides. These clays are generally crystalline complex silicates. These clays include bentonite, attapulgite, hectorite, illite, saponite, sepiolite, biotite, vermiculite, zeolite clays and the like.

EXAMPLE G-1

A grease is prepared by incorporating 3.5% by weight of the product of Example, 1.2% of the product of example P-3, 0.5% by weight of dibutyl hydrogen phosphite, and 0.3% of the product of Example P-9 into a lithium grease, Southwest Petro Chem Lithium 12 OH Base Grease.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for making a lubricating oil composition, comprising:

(1) preparing an intermediate product by reacting isobutylene, or a dimer, trimer or tetramer of isobutylene, or a mixture thereof, with sulfur and hydrogen sulfide;

(2) fractionally distilling the intermediate product from step (1) at a subatmospheric pressure in the range of about 1 to about 250 mmHg and a reflux ratio in the range of about 2.1 to about 8:1 to provide a dihydrocarbyl polysulfide mixture comprising at least about 90% dihydrocarbyl trisulfide, from about 0.5 to about 8% dihydrocarbyl disulfide, and less than about 5% dihydrocarbyl higher polysulfides; and (3) blending a mixture comprising a major amount of an oil of lubricating viscosity, (a) an extreme pressure improving amount of the product from step (2), and an antiwear or an extreme pressure improving amount of the combination of (b),at least one ammonium salt of a phosphoric acid ester, (c) at least one phosphite, and (d) at least one monothiophosphate or at least one reaction product of a phosphite and sulfur or a source of sulfur.

2. The process of claim 1 wherein the ammonium salt of (b) is derived from an amine.

3. The process of claim 1 wherein the ammonium salt of (b) is derived from at least one tertiary aliphatic primary amine.

4. The process of claim 1 wherein the phosphoric acid ester is prepared by reacting a phosphorus acid or anhydride with at least one alcohol containing from one to about 30 carbon atoms.

5. The process of claim 1 wherein the phosphite (c) is a dihydrocarbyl or trihydrocarbyl phosphite wherein each hydrocarbyl group independently contains from about one to about 30 carbon atoms.

6. The process of claim 1 wherein each hydrocarbyl group independently contains from about one to about eight carbon atoms.

7. The process of claim 5 wherein each hydrocarbyl group is an aryl group.

8. The process of claim 1 wherein the monothiophosphate is a dihydrocarbyl or trihydrocarbyl thiophosphate independently containing from about one to about 30 carbon atoms in each of the hydrocarbyl groups.

9. The process of claim 1 wherein the phosphite of (d) is a trihydrocarbyl phosphite.

10. The process of claim 1 wherein the phosphite of (d) is a triaryl phosphite.

11. The process of claim 1 wherein the mixture blended during step (3) further comprises (e) at least one dispersant or at least one borated overbased metal salt of an acidic organic compound.

12. The process of claim 11 wherein (e) is at least one dispersant selected from the group consisting of an acylated amine, a carboxylic ester, a Mannich reaction product, and a hydrocarbyl substituted amine.

13. The process of claim 11 wherein the dispersant (e) is at least one reaction product of a hydrocarbyl substituted carboxylic acylating agent and a polyamine.

14. The process of claim 11 wherein the dispersant (e) contains boron.

15. The process of claim 11 wherein the borated overbased salt is prepared by reacting an overbased metal salt of an acidic organic compound with a boron compound.

16. The process of claim 1 wherein (a) is present in an amount from about 0.1% up to about 10% by weight and (b) is present in an amount from about 0.1% up to about 5% by weight, (c) is present in an amount from about 0.1% up to about 5% by weight, and (d) is present in an amount from about 0.1% up to about 5% by weight.

17. The process of claim 1 wherein the lubricating composition is a gear oil.

18. The process of claim 1 wherein (b) is an ammonium salt of a phosphoric acid ester prepared by reacting a phosphoric acid or anhydride with an alcohol containing from about four up to about eighteen carbon atoms.

19. The process of claim 1 wherein (c) is a hydrocarbyl phosphite and each hydrocarbyl group of (c) contains from about two to about eight carbon atoms.

20. The process of claim 1 wherein (d) is at least one aromatic monothiophosphate or at least one reaction product of an aromatic phosphite and sulfur or a source of sulfur.

21. The process of claim 1 wherein (d) is a reaction product of triphenyl phosphite and sulfur or a source of sulfur.

22. A process for making a concentrate, comprising:

(1) preparing an intermediate product by reacting isobutylene, or a dimer, trimer or tetramer of isobutylene, or a mixture thereof, with sulfur and hydrogen sulfide;

(2) fractionally distilling the intermediate product from step (1) at a subatmospheric pressure in the range of about 1 to about 250 mmHg and a reflux ratio in the range of about 2:1 to about 8:1 to provide a dihydrocarbyl polysulfide mixture comprising at least about 90% dihydrocarbyl trisulfide, from about 0.5 to about 8% dihydrocarbyl disulfide, and less than about 5% dihydrocarbyl higher polysulfides; and (3) blending a mixture comprising from about 0.1% up to about 90% by weight of a substantially inert organic diluent, (a) the product from step (2), and the combination of (b) at least one ammonium salt of a phosphoric acid ester, (c) at least one phosphite, and (d) at least one thiophosphate or at least one reaction product of a phosphite and sulfur or a source of sulfur.

* * * * *